US006328222B1

(12) United States Patent
Warner et al.

(10) Patent No.: US 6,328,222 B1
(45) Date of Patent: Dec. 11, 2001

(54) PULSED AIR ASSIST VALVE MODULE

(75) Inventors: Vernon R. Warner, Wicomico; Harry R. Brooks; Jeff B. Pace, both of Newport News; James Cohen, Virginia Beach, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/557,975

(22) Filed: Apr. 25, 2000

(51) Int. Cl.[7] ..... F02D 1/06

(52) U.S. Cl. ..... 239/5; 239/533.2; 239/585.1; 239/408; 137/607; 137/898; 137/628; 137/870; 123/585

(58) Field of Search ..... 239/5, 533.1, 533.12, 239/585.1, 585.5, 406, 417; 137/898, 628, 870; 251/129.21; 123/585, 531

(56) References Cited

U.S. PATENT DOCUMENTS

| | | | | |
|---|---|---|---|---|
| 3,782,639 | | 1/1974 | Boltz et al. | 239/405 |
| 3,996,906 | * | 12/1976 | Bubniak et al. | 239/408 |
| 4,794,901 | | 1/1989 | Hong et al. | 123/533 |
| 4,834,291 | * | 5/1989 | Kollmann | 239/408 |
| 5,046,472 | * | 9/1991 | Linder | 123/533 |
| 5,115,786 | | 5/1992 | Yamada | 123/531 |
| 5,156,133 | | 10/1992 | Sugimoto et al. | 123/533 |
| 5,205,492 | * | 4/1993 | Khinchuk | 239/533.4 |
| 5,218,943 | | 6/1993 | Takeda et al. | 123/531 |
| 5,315,973 | | 5/1994 | Hill et al. | 123/304 |
| 5,409,169 | | 4/1995 | Saikalis et al. | 239/404 |
| 5,934,567 | | 8/1999 | Fly | 239/408 |

FOREIGN PATENT DOCUMENTS

| | | |
|---|---|---|
| 0 360 040 | 3/1990 | (EP) . |
| 0 683 315 A1 | 11/1995 | (EP) . |

* cited by examiner

*Primary Examiner*—Lesley D. Morris
*Assistant Examiner*—Dinh Q. Nguyen

(57) ABSTRACT

A fuel injector for use in a internal combustion engine is disclosed. The fuel injector includes a body having a discharge end and a longitudinal axis extending therethrough, and an electromagnetic coil located within the body. The fuel injector further includes a fuel metering valve operable between an open position and a closed position and an air metering valve operable between an open position and a closed position. The fuel injector also includes a valve seat located within the body proximate to the discharge end and includes an orifice extending therethrough along the longitudinal axis. A needle is reciprocally mounted along the longitudinal axis between an open position and a closed position. The needle has an upstream end, a downstream end, and a needle channel extending therethrough along the longitudinal axis. The needle engages the valve seat in the closed position. A guide is disposed along the longitudinal axis such that the upstream end of the needle is reciprocable within the guide. A seal having a seal opening therethrough is located within the guide. A bellows fluidly connects the seal opening and the needle channel. The bellows and the guide form a generally annular chamber therebetween. The bellows is movable between a compressed and an extended position. The annular chamber is adapted to receive fuel. The seal prevents the fuel in the annular chamber from entering the needle channel. A method of operating the fuel injector is also disclosed.

27 Claims, 5 Drawing Sheets

PULSED AIR ASSIST VALVE MODULE

FIELD OF THE INVENTION

This invention relates to fuel injectors, and more particularly, to fuel injectors having a pulsed air assist air valve module.

BACKGROUND OF THE INVENTION

Fuel injectors are commonly employed in internal combustion engines to provide precise metering of fuel for injection into each combustion chamber. An electromagnetic fuel injector typically utilizes an electromagnetic solenoid assembly to supply an actuating force to a fuel metering valve. Typically, the fuel metering valve is a plunger style needle valve which reciprocates between a closed position, where the needle is seated in a valve seat to prevent fuel from escaping through a metering orifice into the combustion chamber, and an open position, where the needle is lifted from the valve seat, allowing fuel to discharge through the metering orifice for injection into the combustion chamber.

The fuel injector atomizes the fuel during injection into the combustion chamber, breaking the fuel into a large number of very small particles, increasing the surface area of the fuel being injected, and allowing the oxidizer, typically ambient air, to more thoroughly mix with the fuel prior to combustion. The precise metering and atomization of the fuel reduces combustion emissions and increases the fuel efficiency of the engine.

Additionally, pressurized assist air can be injected into the fuel to assist in the atomization of the fuel into small particles. To optimize the fuel break-up, it would be beneficial to provide the pressurized air generally along the same direction as the fuel flow in order to reduce fuel pressure loss due to the air impacting the fuel. To do this, the air can be provided through a hollow needle. However, due to clearances between parts, fuel can leak into the needle, impeding the air flow.

It would be beneficial to provide a fuel injector in which both fuel and assist air is provided simultaneously by the operation of the fuel injector, and in which fuel cannot leak into the supply of assist air.

SUMMARY OF THE INVENTION

Briefly, the present invention provides a fuel injector for an internal combustion engine The fuel injector comprises a body and a fuel metering valve reciprocally located within the body. The fuel metering valve is operable between an open position and a closed position. The fuel injector also includes an air metering valve reciprocally located within the body, the air metering valve being operable between an open position and a closed position and an electromagnetic coil operatively connected to each of the fuel metering valve and the air metering valve to reciprocate the fuel metering valve and the air metering valve between the open position and closed positions.

The present invention also provides a fuel injector for an internal combustion engine. The fuel injector comprises a body having a discharge end and a longitudinal axis extending therethrough and a valve seat located within the body proximate to the discharge end. The valve seat includes an orifice extending therethrough along the longitudinal axis. The fuel injector also includes a needle reciprocally mounted along the longitudinal axis between an open position and a closed position. The needle having an upstream end, a downstream end, and a needle channel extending therethrough along the longitudinal axis. The needle engages the valve seat in the closed position. The fuel injector further includes a guide disposed along the longitudinal axis upstream of the needle and a seal located within the guide. The seal has a seal opening therethrough. The fuel injector also includes a bellows communicating the seal opening and the needle channel.

The present invention also provides a method of providing an atomizing air stream to fuel within a fuel injector. The method comprises providing a fuel injector having a body and a fuel metering valve reciprocally located within the body. The fuel metering valve is operable between an open position and a closed position. The fuel injector also includes an air metering valve reciprocally located within the body, the air metering valve being operable between an open position and a closed position and an electromagnetic coil operatively connected to each of the fuel metering valve and the air metering valve to reciprocate the fuel metering valve and the air metering valve between the open position and closed positions. The method further comprises providing fuel through the fuel metering valve and providing air through the air metering valve so that the air mixes with the fuel and assists in atomizing the fuel.

The present invention also provides a fuel valve for an air assisted fuel injector. The fuel valve comprises a needle having a longitudinal axis, an upstream end, a downstream end and a needle channel extending therethrough along the longitudinal axis. The fuel valve also includes a generally annular guide disposed along the longitudinal axis upstream of the needle and a seal located within the guide. The seal has a seal opening therethrough. The fuel valve also includes a bellows communicating the seal opening and the needle channel.

Additionally, the present invention provides a bellows for a fuel injector. The bellows comprises a first portion having a first portion interior and a first portion exterior and a second portion having a second portion interior and a second portion exterior. The second portion is biased away from the first portion. The bellows further includes a middle portion connecting the first portion and the second portion. The middle portion has a middle portion interior and a middle portion exterior. The middle portion has a plurality of first sections aligned in a first oblique direction to the longitudinal axis and a plurality of second sections aligned in a second oblique direction to the longitudinal axis. The first and second sections are alternately spaced.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE PREFERRED EMBODIMENT

Figure 1:
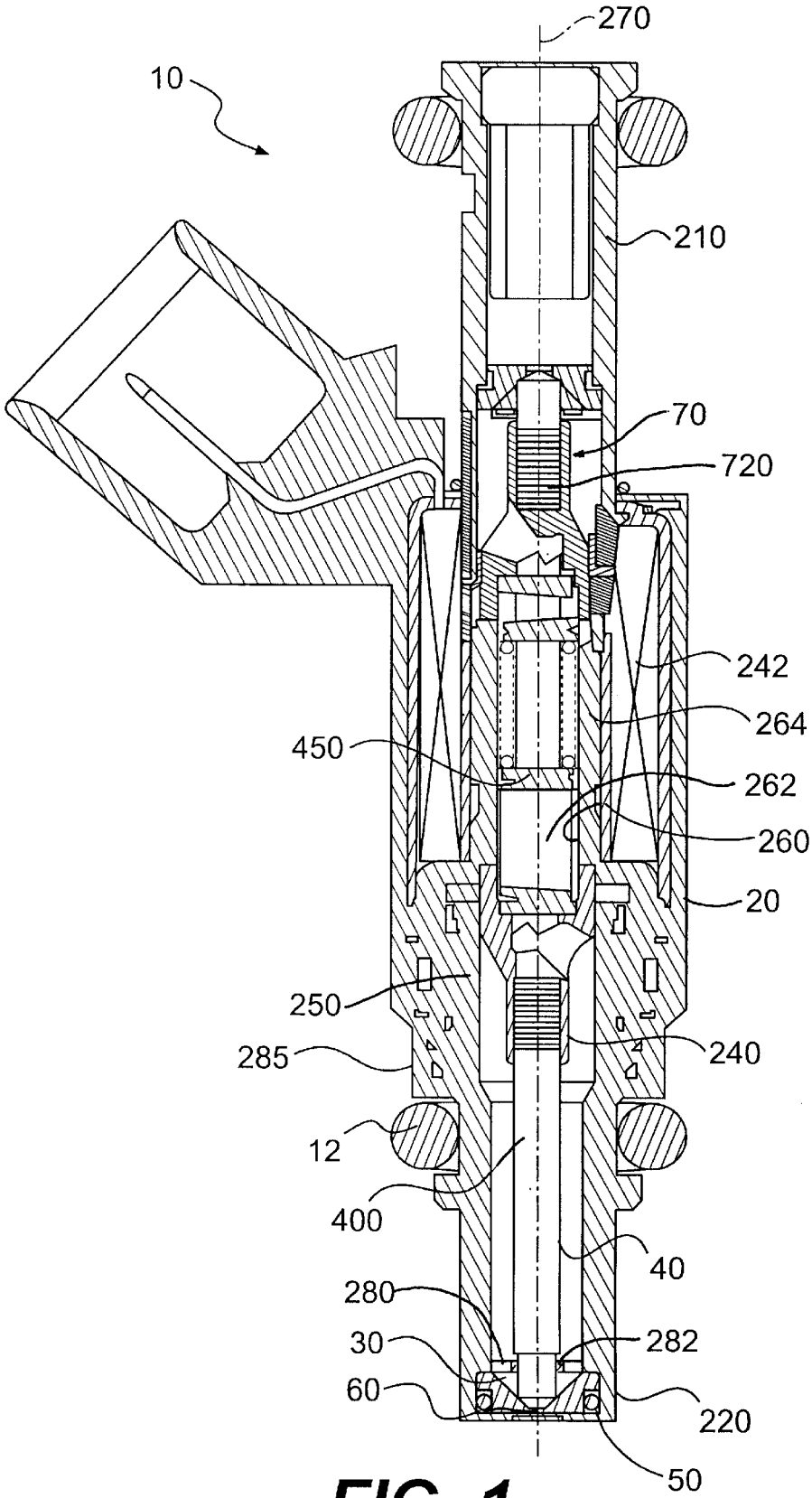
FIG. 1 is a side view, partially in section, of a fuel injector according to the present invention.

In the drawings, like numerals are used to indicate like elements throughout. A preferred embodiment of the present invention, shown in FIGS. 1–5, is a fuel injector 10 for use in a fuel injection system of an internal combustion engine. Referring to FIG. 1, the injector 10 includes a body 20, a valve seat 30, a fuel valve assembly 400 comprised of a needle 40, a generally planar fuel metering orifice 50, a mixing chamber or sac 60, and an air inlet system 70 comprised of an air metering needle 720. Details of the operation of the fuel injector 10 in relation to the operation of the internal combustion engine (not shown) are well known and will not be described in detail herein, except as the operation relates to the present invention. Although the present invention is generally directed to injector valves for internal combustion engines, those skilled in the art will recognize from present disclosure that the present invention can be adapted for other applications in which precise metering of fluids is desired or required.

Still referring to FIG. 1, the body 20 has an upstream or inlet end 210 and a downstream or outlet end 220. As used herein, the term "upstream" generally refers to a portion of the injector 10 or a fluid flow proximate to the top of the injector 10, and "downstream" generally refers to a portion of the injector 10 or a fluid flow proximate to the bottom of the injector 10. The body 20 includes an armature 240 enclosed therein. An electromagnetic coil 242 located within the body 20 is selectively energized and deenergized to reciprocate the armature 240 and the needle 40 within the body 20. The body 20 further includes a valve body shell 250 which is constructed from ferromagnetic material and which forms part of a magnetic circuit which operates the electromagnetic coil 242. The valve body shell 250 partially surrounds a valve body 260 which includes a chamber 262. The chamber 262 extends through a central longitudinal portion of the body 20 along a longitudinal axis 270 extending therethrough and is formed by an interior wall 264. A needle guide 280 having a central needle guide opening 282 and a plurality of radially spaced fuel flow openings 284 (shown in FIGS. 2 and 3) is located within the chamber 262 proximate to the downstream end 220 of the body 20. The needle guide 280 assists in maintaining reciprocation of the needle 40 along the longitudinal axis 270. Referring back to FIG. 1, an overmold 285 constructed of a dielectric material, preferably a plastic or other suitable material, encompasses the valve body shell 250. An o-ring 12 is located around the outer circumference of the valve body 260 to seat the injector 10 in an internal combustion engine (not shown).

Figure 2:
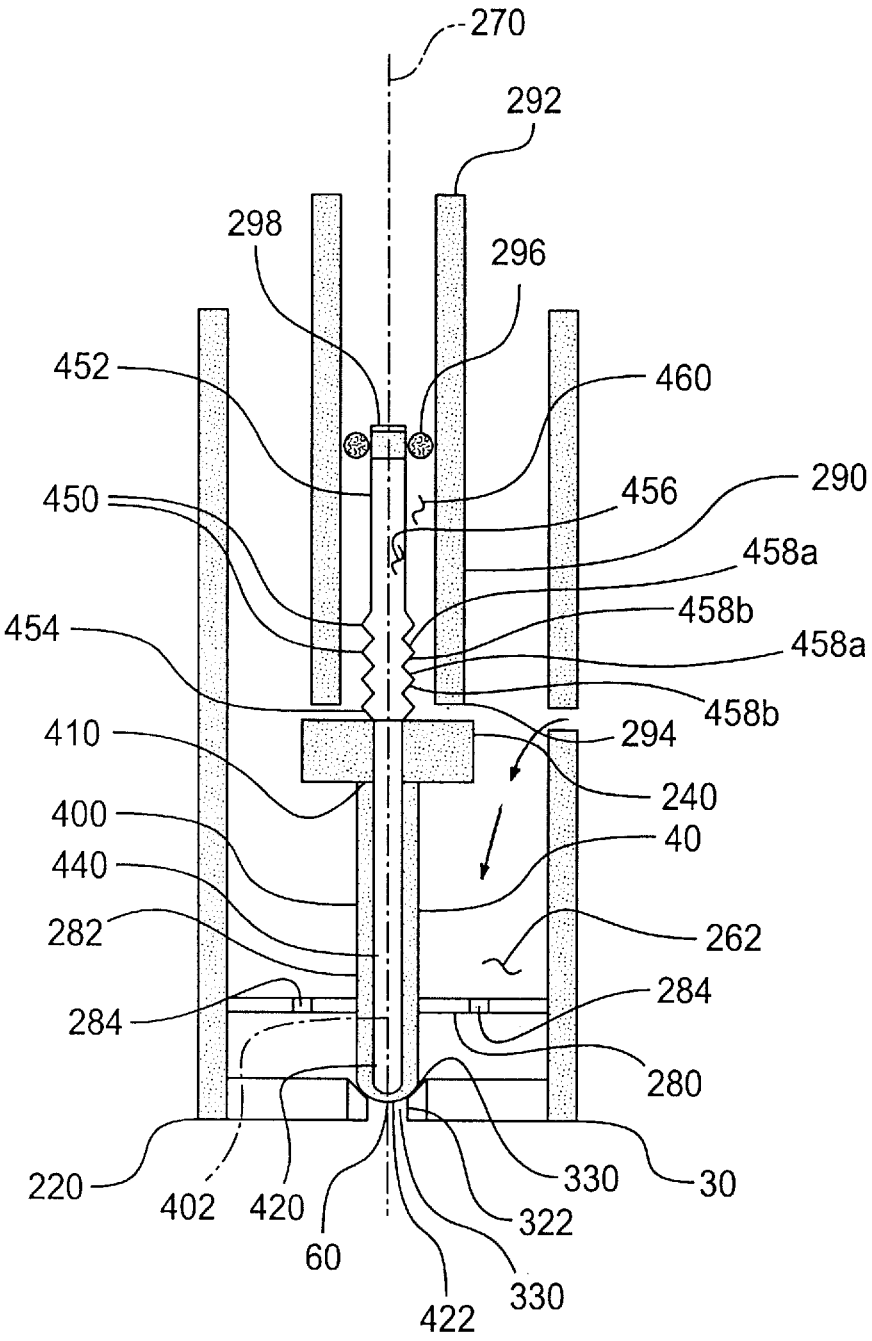
FIG. 2 is an enlarged side view, in section, of a downstream end of a fuel injector according to the present invention with a fuel metering needle in a closed position.
Figure 3:
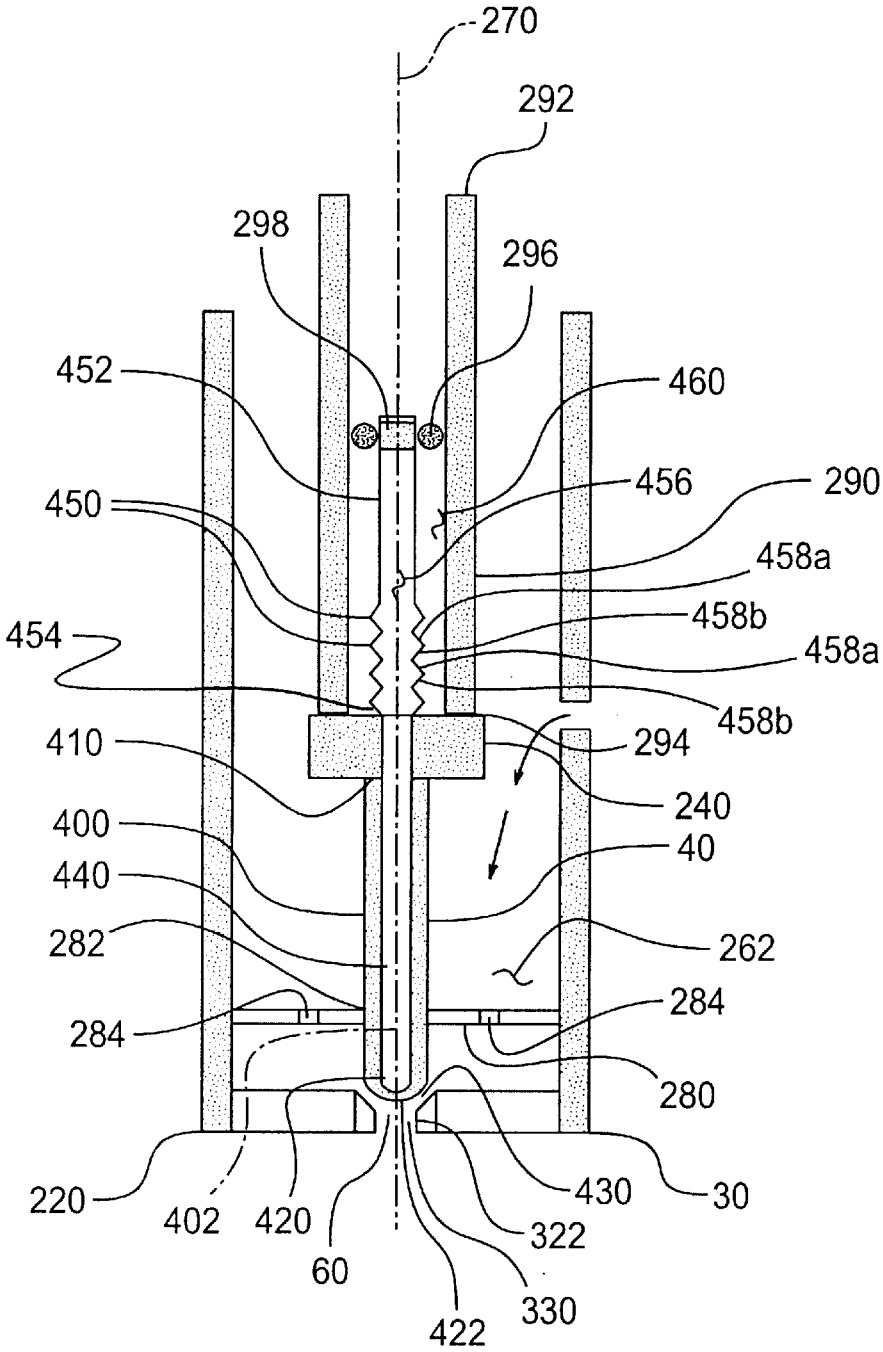
FIG. 3 is a side view, in section, of the downstream end of the fuel injector according to the present invention with the fuel metering needle in an open position.

Referring now to FIGS. 2 and 3, the fuel valve assembly further includes a guide or inlet tube 290, which extends along the longitudinal axis 270. The inlet tube 290 includes an upstream end 292 and a downstream end 294 and helps to guide the armature 240 during operation. The location of the inlet tube 290 in the body 20 determines the maximum height that the needle 40 lifts during operation. The inlet tube 290 communicates with a source of pressurized air (not shown) at the upstream end 292 of the inlet tube 290 such that air is able to pass between the source of pressurized air and the inlet tube 290. A seal 296 is located within the inlet tube 290, between the upstream end 292 and the downstream end 294. The seal 296 includes a seal opening 298 extending therethrough, preferably along the longitudinal axis 270.

The valve seat 30 is located within the chamber 262 proximate to the outlet end 220 between the needle guide 280 and the discharge end 220. The valve seat 30 includes a passage or orifice 320 which extends generally along the longitudinal axis 270 of the body 20 and is formed by a generally cylindrical wall 322. The valve seat 30 also includes a beveled sealing surface 330 which surrounds the orifice 320 and which tapers radially downstream and inward toward the orifice 320 such that the sealing surface 330 is oblique to the longitudinal axis 270.

The needle 40 is reciprocally located within the chamber 262 generally along the longitudinal axis 270 of the body 20. The needle 40 includes a longitudinal axis 402 which is co-linear with the longitudinal axis 270 of the body 20. The needle 40 is reciprocable between a first, or open, position wherein the needle 40 is displaced from the valve seat 30 (as shown in FIG. 3), allowing pressurized fuel to flow downstream past the needle 40, and a second, or closed, position wherein the needle 40 is biased against the valve seat 30 (as shown in FIG. 2) by a biasing element, preferably a bellows 450, precluding fuel flow past the needle 40. The bellows 450 is preferably constructed from a spring-type metal for reasons that will be explained later herein.

Referring now to FIGS. 2 and 3, the needle 40 is located downstream of the inlet tube 290. The needle 40 includes an upstream end 410 and a downstream end 420. The upstream end 410 is fixedly connected to the armature 240. The downstream end 420 includes a generally rounded valve contact face 422 which sealingly engages the beveled valve sealing surface 330 when the needle 40 is in the closed position. However, those skilled in the art will recognize that the downstream end 420 can be other shapes, including but not limited to, conical or frusto-conical, as well. Additionally, the downstream end 420 can include an extension (not shown) which extends into the sac 60, reducing the area of the sac 60. When the needle 40 is in the open position (shown in FIG. 3), a generally annular channel 430 is formed between the valve contact face 422 and the valve sealing surface 330, allowing fuel flow to the orifice 320 for discharge from the injector 10.

The needle 40 is hollow and includes a needle channel 440, which extends along the longitudinal axis 402 of the needle 40 between the upstream end 410 and the downstream end 420. The bellows 450, located within the inlet tube 290, is fixedly connected to the inlet tube 290 through the seal 296 at a first portion or upstream end 452. A second portion or downstream end 454 of the bellows 450 is fixedly connected to the upstream end of the needle 40. A middle portion 458 connects the upstream end 452 and the downstream end 454. The middle portion 458 has a plurality of first sections **458*a* aligned in a first oblique direction to the longitudinal axis 270 and a plurality of second sections 458*b* aligned in a second oblique direction to the longitudinal axis 270. The first and second sections 458*a*, 458*b* are alternately spaced to allow compression and extension of the bellows 450 as will be described in more detail herein. Each of the upstream end 452, the downstream end 454, and the middle portion 458 includes and interior and an exterior. A longitudinal channel 456 of the bellows 450, comprised of the interiors of each of the upstream end 452, the downstream end 454, and the middle portion 458, communicates the seal opening 298 with the needle channel 440 such that fluid can pass between the seal opening 298 and the needle channel 440. The bellows 450 is movable between a compressed position when the needle 40 is in the open position and an extended position when the needle 40 is in the closed position. Preferably, the bellows 450 is biased to the extended position to seat the needle contact face 422 against the sealing surface 330 of the valve seat 30 and to bias the needle 40 away from the inlet tube 290. Those skilled in the art will recognize that the bellows 450 can be constructed from other than a spring material, and a separate biasing spring (not shown) can be used to bias the needle 40** to the closed position.

A generally annular channel 460 is formed between the exterior of the bellows 450 and the inlet tube 290. An upstream end of the channel 460 is sealed by the seal 296, and a downstream end of the channel 460 is in fluid communication with an opening formed between the interface of the armature 240 and the inlet tube 290, such that any fuel that leaks past the interface of the armature 240 and the inlet tube 290 is trapped within the annular channel 460, and cannot flow into the upstream end 292 of the inlet tube 290. In other words, the bellows 450 hermetically separates the annular channel 460 and the needle channel 440.

Figure 4:
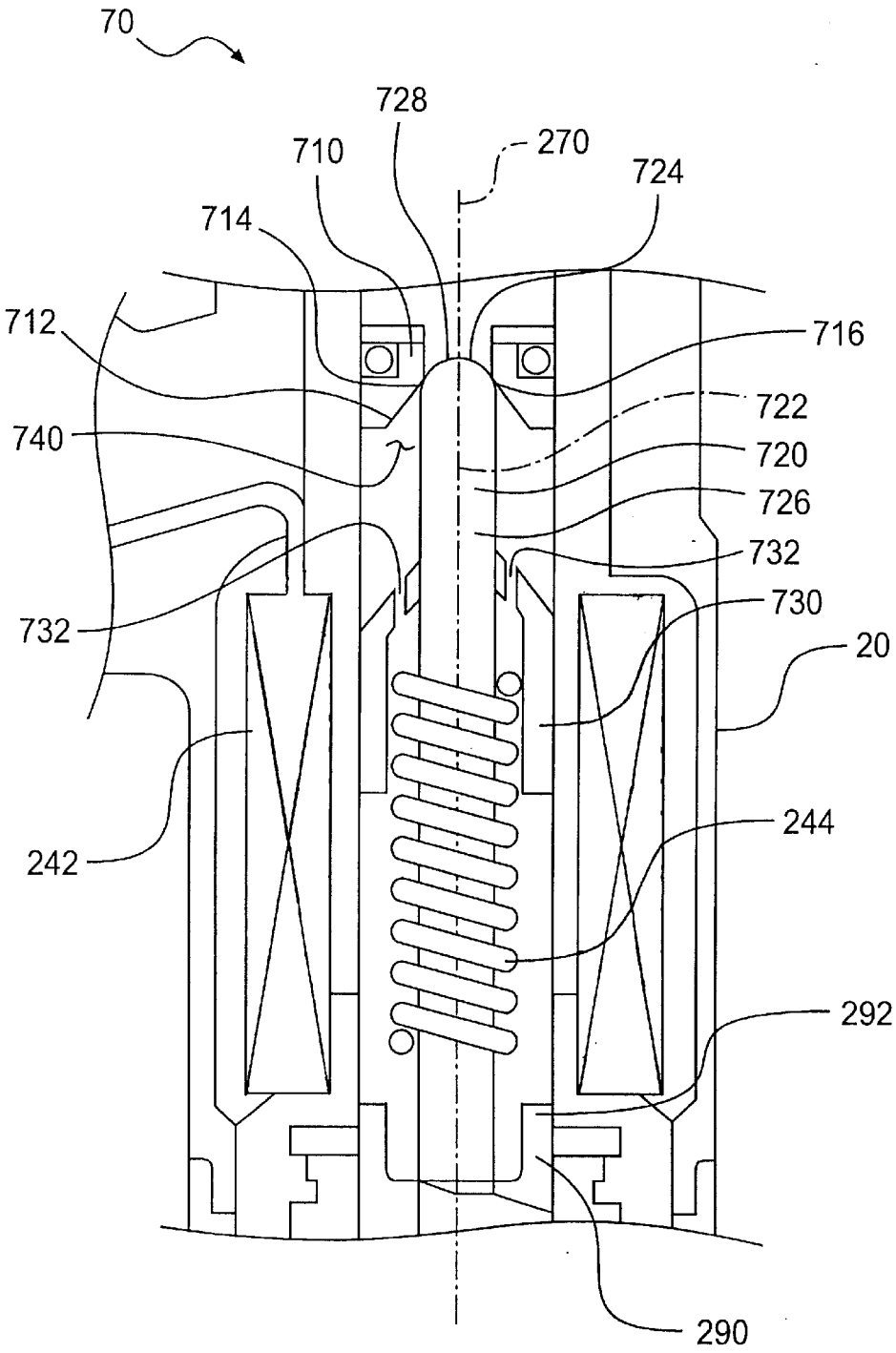
FIG. 4 is a side view, in section, of an upstream end of a fuel injector according to the present invention with an assist air metering needle in a closed position.
Figure 5:
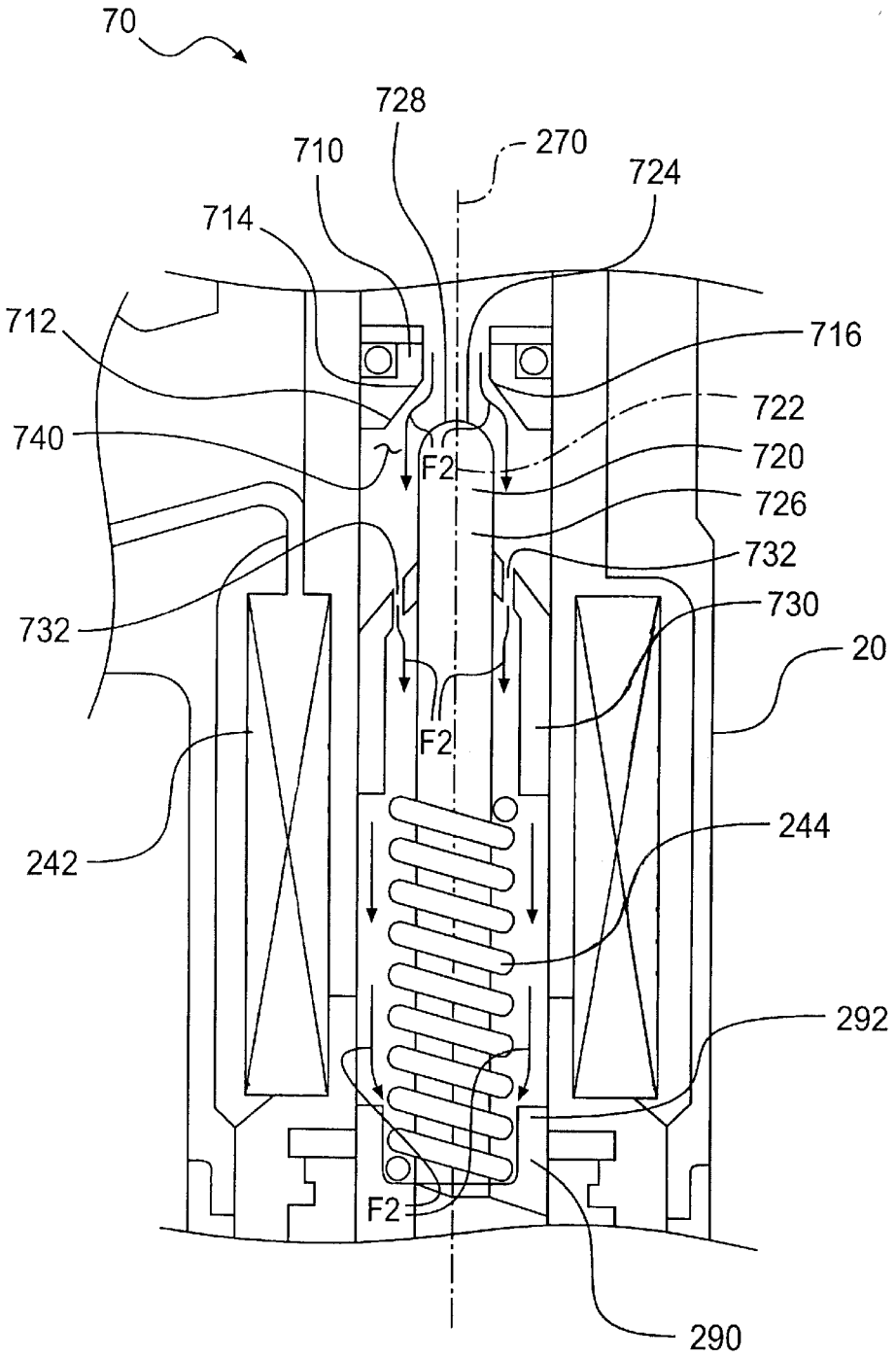
FIG. 5 is a side view, in section, of the upstream end of the fuel injector according to the present invention with the assist air metering needle in an open position.

Referring now to FIGS. 4 and 5, the air inlet system 70 includes a seat 710, the air metering needle 720, an armature 730, and an air chamber 740, located downstream of the seat 710. The seat 710 includes a beveled contact surface 712, which extends downstream and away from the longitudinal axis 270. The contact surface 712 includes a sealing area 714, which engages the air needle 720 when the air needle 720 is in the closed position. The seat 710 further includes a seat orifice 716, which extends through the seat 710 along the longitudinal axis 270.

The air needle 720 is reciprocably located within the body 20 along the longitudinal axis 270. The needle 720 includes a longitudinal axis 722, which is co-linear with the longitudinal axis 270 of the body 20. The electromagnetic coil 242 is operatively connected to the needle 720 so that the needle 720 is reciprocable between a first, or open, position wherein the needle 720 is displaced from the seat 710 (as shown in FIG. 5), allowing pressurized air from an assist air source (not shown) to flow downstream through the seat orifice 716 and past the needle 720, and a second, or closed, position wherein the needle 720 is biased against the seat 710 (as shown in FIG. 4) by a biasing element, preferably a spring 244, precluding air flow through the seat orifice 716 and past the needle 720.

Referring still to FIGS. 4 and 5, the needle 720 also includes an upstream end 724 and a downstream end 726. The upstream end 724 includes a generally rounded valve contact face 728 which sealingly engages the sealing area 714 when the needle 720 is in the closed position. However, those skilled in the art will recognize that the upstream end 724 can be other shapes, including but not limited to, conical or frusto-conical, as well. The downstream end 726 of the needle 720 is fixedly connected to the armature 730. The armature 730 includes a plurality of air openings 732 which allow air to communicate between the air chamber 740 and the upstream end 292 of the inlet tube 290.

The operation of the injector 10 is as follows. Preferably, the injector 10 is a bottom fuel feed injector. Pressurized fuel flow into the injector 10 is provided by a fuel pump (not shown). The pressurized fuel enters the injector 10 and passes through a fuel filter (not shown) and into the chamber 262. The fuel flows through the valve body 260, the fuel flow openings 284 in the guide 280 to the interface between the valve contact face 422 and the valve sealing surface 330. In the closed position (shown in FIG. 2), the needle 40 is biased against the valve seat 30 so that the valve contact face 422 sealingly engages the valve sealing surface 330, preventing flow of fuel through the metering orifice 50. The air needle 720 is biased to a closed position against the seat 710, precluding assist air flow through the seat orifice 716.

In the open position (shown in FIG. 3), the electromagnetic coil 242 or other actuating device overcomes the biasing force of the bellows 450, compressing the bellows 450 at the middle portion 458, and reciprocates the needle 40 to an open position, removing the valve contact face 422 of the needle 40 from the sealing surface 330 of the valve seat 30 and forming the generally annular channel 430. The pressurized fuel within the chamber 262 flows through the annular channel 430, through the valve seat orifice 320 and into the sac 60, as shown by the arrows F1 in FIG. 3, where the fuel impacts on the metering orifice 50. Some of the fuel flows through a space between the armature 240 and the inlet tube 290, and into the annular channel 430. The bellows 450 and the seal 296 prevent the fuel from entering the needle channel 440.

Preferably, the spring 244 has a lower spring coefficient than the bellows 450, so that the electromagnetic coil 242 activates the air supply armature 730 prior to the armature 240, overcoming the biasing force of the spring 244, and pulling the air needle 720 away from the seat 710 before the needle 40 is pulled away from the valve seat 30. Pressurized air enters the air chamber 740 through the seat orifice 716, as shown by the arrows F2 in FIG. 5 and flows through the openings 732 in the armature 730 to the upstream end of the inlet tube 290. The air flows through the inlet tube 290 toward the downstream end 294, through the seal opening 298, through the longitudinal channel 456 of the bellows 450, and through the needle channel 440. The air is discharged from the downstream end 420 of the needle 40 and into the sac 60 (shown in FIG. 3), where the air mixes with the fuel, generating turbulence in the fuel and assisting in atomizing the fuel. The fuel/air mixture then flows through the metering orifice 50 and into the combustion chamber (not shown) for combustion.

When a pre-determined amount of fuel has been injected into the combustion chamber, the electromagnetic coil 242 or other actuating device deactivates, allowing the bellows 450 to extend and bias the needle 40 to the closed position, seating the valve contact face 422 of the needle 40 onto the sealing surface 330 of the valve seat 30 and closing the generally annular channel 430. Since the spring 244 preferably has a lower spring coefficient than the bellows 450, the air needle 720 closes after the needle 40. When the air needle 720 closes, the air needle 720 shuts off the flow of pressurized air to the injector 10. Those skilled in the art will recognize that the bellows 450 and the spring 244 can have different spring coefficients so that the needle 40 moves to the open position before the air needle 720 and to the closed position after the air needle 720, or the bellows 450 and the spring 244 can have similar spring coefficients, so that the needles 40, 720 move to the open and closed positions at the same time.

By adding assist air through the needle 40 into the sac 60 to mix with fuel in the sac 60, turbulence is generated which improves atomization of the fuel in the sac 60 prior to metering through the metering orifice 50. The improved spray atomization of the fuel through the metering orifice 50 into the fuel chamber decreases unwanted hydrocarbon emissions and increases the fuel efficiency of the internal combustion engine.

Preferably, in each of the embodiments described above, the valve seat 30, the needle 40, the metering orifice 50, and the air inlet system 70 are each constructed from stainless steel. However, those skilled in the art will recognize that the valve seat 30, the needle 40, the metering orifice 50, and the air inlet system 70 can be constructed of other, suitable materials.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector for an internal combustion engine comprising:

a body having a longitudinal axis;

a fuel metering valve reciprocally located within the body, the fuel metering valve being operable between an open position and a closed position;

an air metering valve reciprocally located within the body, the air metering valve being operable between an open position and a closed position; and an electromagnetic coil positioned between each of the fuel metering valve and the air metering valve along the longitudinal axis, the electromagnetic coil operative to reciprocate the fuel metering valve and the air metering valve in opposite directions along the longitudinal axis to place the respective air metering and fuel metering valves in their respective open position.

2. The fuel injector according to claim 1 wherein, when the fuel metering valve and the air metering valve are in the open position, fuel from the fuel metering valve and air from the air metering valve mix together, the air assisting in atomizing the fuel.

3. The fuel injector according to claim 2, wherein the fuel metering valve includes a needle having a channel extending therethrough, the channel adapted to allow a fluid to flow therethrough.

4. The fuel injector according to claim 1, wherein the fuel metering valve is biased toward the closed position by a first biasing element and the air metering valve is biased toward the closed position by a second biasing element.

5. The fuel injector according to claim 4, wherein the first biasing element has a first biasing coefficient and the second biasing element has a second biasing coefficient.

6. A fuel injector for an internal combustion engine comprising:

a body having a discharge end and a longitudinal axis extending therethrough;

a valve seat located within the body proximate to the discharge end, the valve seat including an orifice extending therethrough along the longitudinal axis;

a needle reciprocally mounted along the longitudinal axis between an open position and a closed position, the needle having an upstream end, a downstream end, and a needle channel extending therethrough along the longitudinal axis, the needle engaging the valve seat in the closed position;

a guide disposed along the longitudinal axis upstream of the needle;

a seal located within the guide, the seal having a seal opening therethrough; and a bellows communicating the seal opening and the needle channel.

7. The fuel injector according to claim 6, wherein the bellows and the guide form a generally annular chamber therebetween.

8. The fuel injector according to claim 7, wherein the bellows hermetically separates the annular chamber and the needle channel.

9. The fuel injector according to claim 6, wherein the bellows is biased to an extended position.

10. The fuel injector according to claim 6, wherein air is forced into the seal opening, through the bellows and through the needle channel for discharge from the downstream end of the needle, the air mixing with the fuel.

11. The fuel injector according to claim 6, further comprising a fuel pathway within the body, the fuel pathway being in fluid communication with the annular chamber.

12. The fuel injector according to claim 6, wherein the guide comprises an inlet tube.

13. The fuel injector according to claim 6, wherein the bellows comprises a spring material.

14. The fuel injector according to claim 6, wherein the fuel injector further comprises an electromagnet located within the body.

15. The fuel injector according to claim 6, wherein the bellows further comprising:

a first portion having a first portion interior and a first portion exterior;

a second portion having a second portion interior and a second portion exterior, the second portion being biased away from the first portion; and a middle portion connecting the first portion and the second portion, the middle portion having a middle portion interior and a middle portion exterior, the middle portion having a plurality of first sections aligned in a first oblique direction to the longitudinal axis and a plurality of second sections aligned in a second oblique direction to the longitudinal axis, the first and second sections being alternately spaced.

16. The bellows according to claim 15, wherein the first portion interior, the middle portion interior, and the second portion interior comprise a fluid channel.

17. A method of providing an atomizing air stream to fuel within a fuel injector, the method comprising:

providing a fuel injector having:

a body disposed along a longitudinal axis;

a fuel metering valve located within the body; and an air metering valve located within the body;

moving the fuel metering valve in a first direction along the longitudinal axis, such that fuel flows through the body; and moving the air metering valve in a second direction opposite to the first direction along the longitudinal axis, such that air flows through the body.

18. The method according to claim 17, further comprising reciprocally operating the fuel metering valve between an open position and a closed position.

19. The method according to claim 18, further comprising reciprocally operating the air metering valve between an open position and a closed position.

20. The method according to claim 19, the body further including an electromagnetic coil operatively connected to each of the fuel metering valve and the air metering valve to reciprocate the fuel metering valve and the air metering valve between the open position and the closed position.

21. A fuel valve for an air assisted fuel injector comprising:

a needle having a longitudinal axis, an upstream end, a downstream end and a needle channel extending therethrough along the longitudinal axis;

a generally annular guide disposed along the longitudinal axis upstream of the needle;

a seal located within the guide, the seal having a seal opening therethrough; and a bellows communicating the seal opening and the needle channel.

22. The fuel valve according to claim 21, wherein the bellows and the guide form a generally annular chamber therebetween.

23. The fuel valve according to claim 22, wherein the bellows hermetically separates the annular chamber and the needle channel.

24. The fuel valve according to claim 21, wherein the bellows is biased to an extended position.

25. The fuel injector according to claim 21, wherein the bellows further comprising:

a first portion having a first portion interior and a first portion exterior;

a second portion having a second portion interior and a second portion exterior, the second portion being biased away from the first portion; and a middle portion connecting the first portion and the second portion, the middle portion having a middle portion interior and a middle portion exterior, the middle portion having a plurality of first sections aligned in a first oblique direction to the longitudinal axis and a plurality of second sections aligned in a second oblique direction to the longitudinal axis, the first and second sections being alternately spaced.

26. The bellows according to claim 25, wherein the first portion interior, the middle portion interior, and the second portion interior comprise a fluid channel.

27. A fuel injector for an internal combustion engine, the fuel injector comprising:

a body having an upstream end and a downstream end, the first and second ends disposed along a longitudinal axis;

a fuel metering valve disposed at one of the upstream and downstream ends, the fuel metering valve reciprocable along the longitudinal axis from a closed position to an open position in a first direction and from an open position to a closed position in a second direction, the second direction being opposite to the first direction; and an air metering valve disposed at the other of the upstream and downstream ends, the air metering valve reciprocable along the longitudinal axis from a closed position to an open position in the second direction and from an open position to a closed position in the first direction.

* * * * *

UNITED STATES PATENT AND TRADEMARK OFFICE

CERTIFICATE OF CORRECTION

PATENT NO. : 6,328,222 B1
DATED : December 11, 2001
INVENTOR(S) : Warner et al.

It is certified that error appears in the above-identified patent and that said Letters Patent is hereby corrected as shown below:

Title page,
Item [54], in the title delete "PULSED AIR ASSIST VALVE MODULE" and insert therefore the following: -- PULSED AIR ASSIST AIR VALVE MODULE --.

Signed and Sealed this

Thirtieth Day of April, 2002

*Attest:*

*Attesting Officer*

JAMES E. ROGAN
*Director of the United States Patent and Trademark Office*